US008863340B2

(12) United States Patent
Schulze

(10) Patent No.: US 8,863,340 B2
(45) Date of Patent: Oct. 21, 2014

(54) METHOD FOR CLEANING METERING LINES IN AUTOMATICALLY CONTROLLED LAUNDRY CARE DEVICES

(75) Inventor: Ingo Schulze, Panketal (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 1310 days.

(21) Appl. No.: 12/668,448

(22) PCT Filed: Jul. 3, 2008

(86) PCT No.: PCT/EP2008/058612

§ 371 (c)(1),
(2), (4) Date: Feb. 9, 2010

(87) PCT Pub. No.: WO2009/010402

PCT Pub. Date: Jan. 22, 2009

(65) Prior Publication Data

US 2010/0199724 A1 Aug. 12, 2010

(30) Foreign Application Priority Data

Jul. 13, 2007 (DE) ..... 10 2007 032 759

(51) Int. Cl.

| | |
|---|---|
| ***B08B 9/00*** | (2006.01) |
| ***D06F 35/00*** | (2006.01) |
| ***D06F 39/02*** | (2006.01) |
| ***D06F 39/08*** | (2006.01) |

(52) U.S. Cl.

CPC ..... *D06F 39/088* (2013.01); *D06F 39/022* (2013.01)

USPC ..... 8/158; 68/3 R; 68/12.18; 68/17 R

(58) Field of Classification Search

CPC ..... D06F 39/088; D06F 39/022

USPC ..... 8/158; 68/3 R, 12.18, 13 R, 17 R; 134/22.12

See application file for complete search history.

(56) References Cited

U.S. PATENT DOCUMENTS

| | | | | | |
|---|---|---|---|---|---|
| 3,160,317 | A | * | 12/1964 | Hambro | 222/1 |
| 4,090,475 | A | | 5/1978 | Kwan | |
| 4,524,801 | A | * | 6/1985 | Magnasco et al. | 137/565.33 |
| 4,845,965 | A | * | 7/1989 | Copeland et al. | 68/17 R |
| 4,932,227 | A | * | 6/1990 | Hogrefe | 68/17 R |
| 5,014,211 | A | | 5/1991 | Turner et al. | |
| 5,208,930 | A | * | 5/1993 | Chabard | 8/158 |
| 5,390,385 | A | * | 2/1995 | Beldham | 8/158 |
| 5,842,599 | A | | 12/1998 | Douma et al. | |

FOREIGN PATENT DOCUMENTS

| | | | |
|---|---|---|---|
| DE | 3237785 | A1 | 9/1983 |
| DE | 3525365 | A1 | 1/1987 |
| DE | 3822246 | A1 | 1/1990 |
| EP | 0421085 | A2 | 4/1991 |
| EP | 1321560 | A2 | 6/2003 |
| WO | 03027377 | A1 | 4/2003 |

* cited by examiner

*Primary Examiner* — Michael Barr
*Assistant Examiner* — Benjamin L Osterhout
(74) *Attorney, Agent, or Firm* — Nixon & Vanderhye, P.C.

(57) ABSTRACT

Flowable laundry treatment agents can be added in automatically metered dosages via a metering line to a laundry treatment process by means of an automatic metering system comprising a reservoir. Advantageously, a metering line of is flushed with a rinsing agent, particularly water, after adding a dose. In order to prevent the development of germs in the residues of the rinsing agents, comprising diluted residues of laundry treatment agents, when remaining in the fluid lines for a longer period of time, exemplary embodiments of the invention provide for the metering line to be flushed immediately before adding a dose.

20 Claims, 1 Drawing Sheet

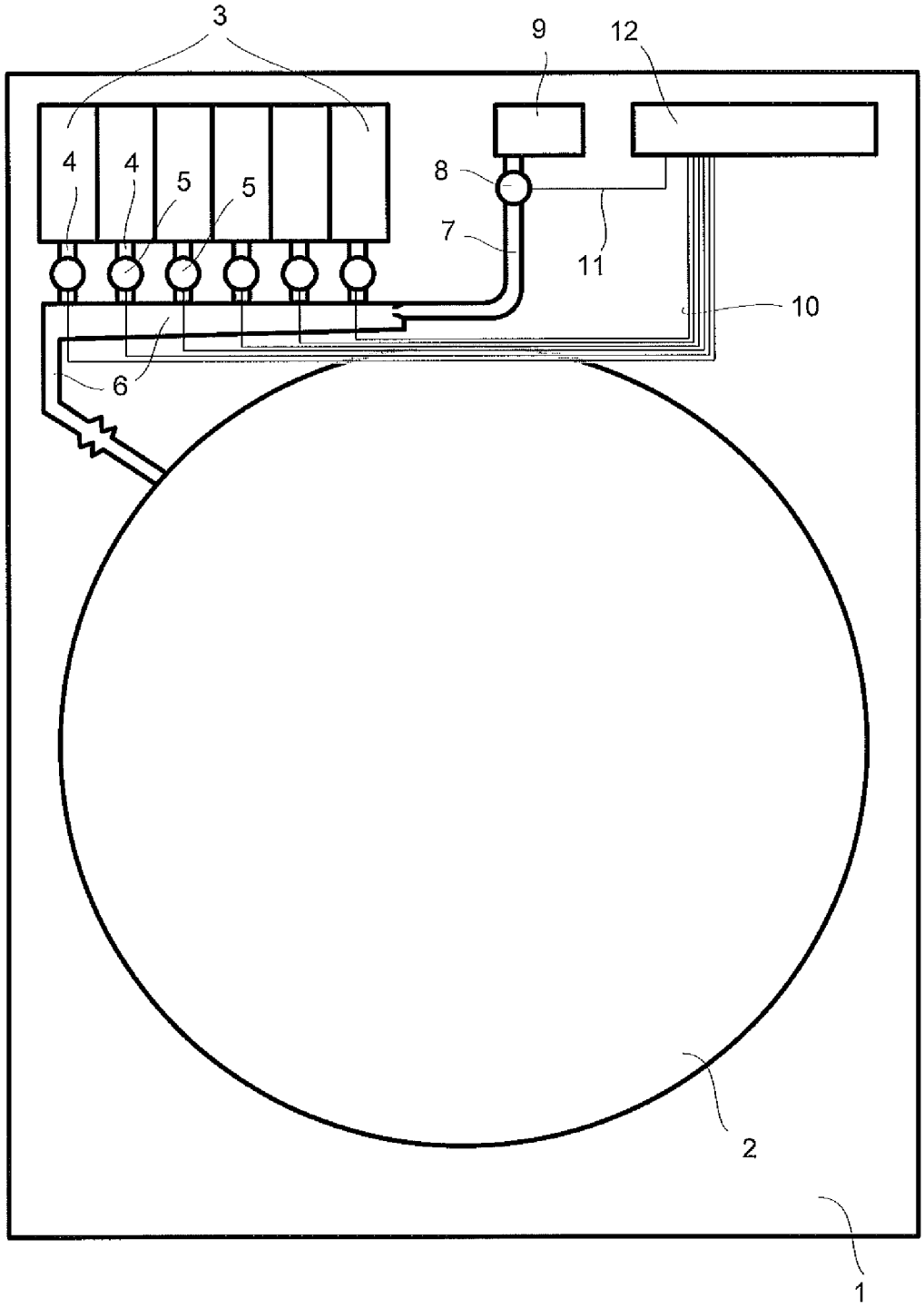
3
9
12
4
4
5
5
8
7
11
10
6
2
1

METHOD FOR CLEANING METERING LINES IN AUTOMATICALLY CONTROLLED LAUNDRY CARE DEVICES

This application is a U.S. National Phase of International Application No. PCT/EP2008/058612, filed Jul. 3, 2008, which designates the U.S. and claims priority to German Application No. 10 2007 032 759.7, filed Jul. 13, 2007, the entire contents of each of which are hereby incorporated by reference.

BACKGROUND OF THE INVENTION

Method for cleaning metering lines in automatically controlled laundry care devices, in which flowable laundry treatment agents are added in automatically metered doses from at least one reservoir via a metering line to a laundry treatment process, it being possible, after adding a dose, to flush said metering line by means of a rinsing agent, in particular by means of water.

Such methods are used in appliances and/or washing machines of the prior art (DE 32 37 785 A1, DE 35 25 365 A1, EP-421 085 A2). Water is regularly used here as a rinsing agent, namely fresh water directly from the mains water supply in DE 32 37 785 A1, fresh water from a water supply, which as is known exists in the detergent supply duct and is used to seal against clouds of vapor developing from the tub (DE 35 25 365 A19) and fresh water from the mains water supply, which is stored in an expendable quantity in a reservoir (EP-421 085 A2). All known techniques of flushing metering lines are used to prevent detergents and washing agents (bleaching agents, softeners) from mixing, as a result of which reactions between different laundry treatment agents may arise. There is a risk of long-chain molecules or water-insoluble connections undesirably developing, or exothermic reactions or damage to individual laundry items occurring. To avoid such dangers, those line areas, which are wet by a respectively metered laundry treatment agent and are subsequently referred to as a metering line, are flushed with said rinsing agent (water, especially fresh water) after its addition.

It is however common to all known measures for flushing the metering line that after flushing, residues of the mixture of fresh water and small proportions of the already flushed laundry treatment agent remain behind. Particularly with the use of organic chemicals (e.g. detergent tensides), this can result in a massively increased potential of germ formation. Correspondingly by contrast, highly concentrated tenside solutions, which, where possible, are even adjusted in terms of alkali, have biocidal properties. Residues of such solutions cannot therefore develop germs.

On the other hand, the portions of washing agent in the remaining residues of rinsing solutions may result in the surface drying, sedimentations or incrustations on delivery facilities (pumps, valves) and may as a result cause interferences in its operation.

BRIEF SUMMARY OF THE INVENTION

The object underlying the invention is to design a method of the type described in the introduction such that the preceding dangers can no longer occur. In particular, preventive measures are to be taken to ensure that residues of diluted laundry treatment agents are not able to develop germs and that different portions in the rinsing solutions can react with one another and the reaction results thereof can seriously interfere with the further process in a laundry care device.

In accordance with the invention, this object is achieved by the characterizing feature of claim 1 in such a manner that the metering line is flushed immediately before adding a dose. This temporary sequence of flushing the metering line, which is changed compared with the prior art, is successful in preventing the formation of germs. Provided namely the metering line has not been flushed and still contains residues of a highly concentrated laundry treatment agent originating from the last addition, no germs can form. On the other hand, highly concentrated residues of laundry treatment agents, which in the absence of previous dilutions, still exist in relatively large quantities, dry out less quickly than very minimal quantities of significantly diluted residues. The flushing process, which is temporarily delayed in respect of the solution of the preceding object, until shortly before the addition of a dose of a further laundry treatment agent, is far more effective than the known flushing process associated with a completed addition of a dose of treatment agent.

If in the case of an inventive method different laundry treatment agents are added via the same metering line, it is particularly advantageous if the metering line is only flushed before a dose of another laundry treatment agent is to be added or if the metering line is only flushed before a dose of an additional laundry treatment agent is to be added, which could react with the laundry treatment agent of the preceding dose. At least parts of the metering lines will regularly come into contact with water or washing solution in the further treatment process, which is no longer interrupted by adding laundry treatment agents, so that the metering line or parts thereof are also flushed without adding further laundry treatment agents. On the other hand, an obligatory control facility of the laundry care device can be informed of the properties of the respective laundry treatment agent and a flushing process can then only occur if the following laundry treatment agents to be metered could react with the preceding.

A flushing of the metering line could also be made dependent on how long ago the directly preceding addition of a dose took place and/or how quickly the laundry treatment agent of the directly preceding metering dries, sediments and/or incrustates, and thus it aggregate state changes. If namely as a result of the anticipated lack of reactions between the doses of consecutive laundry treatment agents or a change in the appliance state, a flushing process is superfluous, this can also be omitted. This saves water and time.

In accordance with a further development of the invention, a flushing process can also be applied in more than one step. This may then be necessary if a time has passed since the last addition of a laundry treatment agent which has the tendency to dry, sediment or incrust, which suggest a change in the aggregate state. The redissolving of the residues of the laundry treatment means would then be performed with a first or further flushing steps and with a subsequent flushing step only the approximately complete flushing process.

In accordance with a further embodiment of the invention, relevant properties of all used laundry treatment means are to be advantageously stored in the laundry care device and taken into consideration when deciding on a flushing process and/or if necessary on the character thereof. Alternatively or in addition, the relevant properties of laundry treatment agents could be determined from current measurement results and taken into account when deciding on a flushing process and/or if necessary the character thereof. In the second case, the control facility could be embodied adaptively and stored properties could be replaced by measurement results concerning a more recent test of the same laundry treatment agent.

For an addition of a further dose following the addition of a dose, in the case of a possible selection of several different laundry treatment means, the control facility could also select that for the following dose, which does not react damagingly to the laundry treatment agent of the preceding addition. Sometimes several possible laundry treatment agents can be selected for individual laundry treatment sections, so that in some circumstances one can be selected which does not react with the preceding.

In such cases, the inventive method can also be improved such that an addition of a further dose following the addition of a dose is already implemented at least partially together with the flushing step or the flushing steps or parts thereof.

BRIEF DESCRIPTION OF THE DRAWINGS

On the basis of an exemplary embodiment illustrated schematically in the drawing, the inventive method is clarified.

The single FIGURE shows parts of a laundry care device which are essential to the invention. A laundry care device may be a washing machine, a tumble dryer or a combination of a washing machine and a tumble dryer.

DETAILED DESCRIPTION OF EXEMPLARY EMBODIMENTS OF THE PRESENT INVENTION

A laundry treatment chamber 2 is arranged within a housing 1, into which the laundry can be filled for the purpose of its treatment (not shown). This laundry treatment chamber 2 can be stationary and contain a container rotating together with the laundry or rotating by itself. Within the housing 1, regardless of which part of its interior chamber, one or a number of reservoirs 3 are arranged for different liquid or gel-like (in any case flowable) laundry treatment agents, the contents of which can be delivered into a shared metering line 6 by way of outlet lines 4 and metering facilities 5. The doses of laundry treatment agents are transferred into the laundry treatment chamber from the metering line 6. A rinsing line 7 is coupled to the highest point on the metering line 6, it being possible to feed said rinsing line, controlled by a rinsing agent controller 8, from a rinsing agent source 9. The metering facilities 5 and the rinsing agent controller 8 are supplied by means of signals by way of suitable lines 10 and/or 11 by a control facility 12 so that each of these facilities supplies the respectively assigned medium at time instants specified by the control facility 12. The rinsing agent source 9 may be a reservoir or buffer container for a certain quantity of rinsing agent (preferably water) or a connection facility to a fresh water network.

All illustrated facilities and appliances are sufficiently known from the prior art and do not require any detailed explanation. These facilities and appliances can be operated according to the afore-cited explanations of the inventive method in order to achieve the object set and explained in the introduction. This method ensures the maintenance-free nature of such an operated metering system, prevents gel formations, incrustrations and damages resulting therefrom in particular on the supplying components. It reduces the pump power to be installed and prevents germs from residues of dissolved laundry treatment agents from forming. These advantages are the main requirement for ensuring the complete functionality of a metering system for several laundry treatment agents over the service life of a laundry care device equipped therewith. The special combination of claimed features renders a resource-saving solution possible, because it is only if there is a risk of a reaction between different laundry treatment agents that a flushing process is initiated. As a result, the guaranteed qualities of the laundry treatment agent are also maintained.

The invention claimed is:

1. An automatically controlled laundry care device, comprising:

a laundry treatment chamber within a housing;

at least one reservoir, each configured to contain different flowable laundry treatment agents;

a metering line;

outlet lines connected to each reservoir and configured to supply the different flowable laundry treatment agents to the metering line;

a rinsing line;

a rinsing agent source configured to provide a rinsing agent;

a rinsing agent controller configured to flush the metering line with the rinsing agent via the rinsing line from the rinsing agent source;

and a laundry care device controller configured to initiate adding a metered dose of the different flowable laundry treatment agents from the reservoir without a post flush operation, and wherein after a delay period of time the laundry device controller is further configured to initiate a flushing by the rinsing agent controller, the flushing configured to occur only immediately before adding another flowable laundry treatment agent.

2. The automatically controlled laundry care device of claim 1, wherein the rinsing agent comprises water.

3. The automatically controlled laundry care device of claim 1, wherein the laundry device controller is programmed to store, determine, and/or measure a property of at least one of the different flowable laundry treatment agents.

4. The automatically controlled laundry care device of claim 3, the rinsing agent controller is configured to flush the metering line based on said property.

5. The automatically controlled laundry care device of claim 1, wherein the laundry device controller is configured to initiate the flushing of the metering line by the rinsing agent controller and add the further metered dose of one of the different flowable laundry treatment agents such that initiating the flushing and adding the further metered dose at least partially overlap.

6. The automatically controlled laundry care device of claim 1, wherein the laundry device controller is configured to initiate the flushing of the metering line based upon a drying time, a sedimentation time, and/or an incrustation time of one of the different flowable laundry treatment agents.

7. The automatically controlled laundry care device of claim 1, wherein the metered dose of one of the different flowable laundry treatment agents and the further metered dose of one of the different flowable laundry treatment agents are different, and wherein the further metered dose is selected so as not to react damagingly with the metered dose.

8. A method for cleaning a metering line in an automatically controlled laundry care device, the method comprising:

adding a flowable laundry treatment agent in a first metered dose from one of at least one reservoir through a metering line to a laundry treatment process without a post-flush operation;

flushing said metering line with a rinsing agent after a delay period of time only immediately before adding another metered dose of another flowable laundry treatment agent from one of at least one reservoir; and immediately following flushing said metering line, adding another flowable laundry treatment in another metered dose from one of the at least one reservoir through the metering line to the laundry treatment process.

9. The method of claim 8, wherein the rinsing agent comprises water.

10. The method of claim 9, further comprising storing a property of a laundry treatment agent in a control facility and wherein the flushing is based upon the stored property.

11. The method of claim 8, wherein first flowable laundry treatment agent and the other flowable laundry treatment agent are different flowable laundry treatment agents.

12. The method of claim 11, determined a property of one of the flowable laundry treatment agent, and wherein flushing is based upon said determined property.

13. The method of claim 12, further comprising measuring said property of one of the flowable laundry treatment agents, and wherein determining is based upon said measured property.

14. The method of claim 8, wherein the flowable laundry treatment agent and the other flowable laundry treatment agent are different flowable laundry treatment agents, said other flowable laundry treatment agent being reactive with the flowable laundry treatment agent.

15. The method of claim 8, wherein the flowable laundry treatment agent and the other flowable laundry treatment agent are different flowable laundry treatment agents, and wherein flushing of said metering line is based upon the delay period of time elapsed following adding of a first dose.

16. The method of claim 15, wherein flushing of said metering line comprises flushing of said metering line more than once.

17. The method of claim 8, wherein the flowable laundry treatment agent and the other flowable laundry treatment agent are different flowable laundry treatment agents, and wherein flushing of said metering line is based upon a drying time, a sedimentation time, and/or an incrustation time of the flowable laundry treatment agent.

18. The method of claim 8, further comprising selecting the other flowable laundry treatment agent for the other metered dose such that the other flowable laundry treatment agent does not react damagingly with the flowable laundry treatment agent of the metered dose.

19. The method of claim 8, wherein adding of the other metered dose at least partially overlaps with flushing of said metering line.

20. The method of claim 8, wherein the flowable laundry treatment agent and the other flowable laundry treatment agent are the same.

* * * * *

UNITED STATES PATENT AND TRADEMARK OFFICE

CERTIFICATE OF CORRECTION

PATENT NO. : 8,863,340 B2
APPLICATION NO. : 12/668448
DATED : October 21, 2014
INVENTOR(S) : Schulze It is certified that error appears in the above-identified patent and that said Letters Patent is hereby corrected as shown below:

In The Claims

Claim 11, line 1: "The method of claim 8, wherein first flowable laundry" should be corrected to --The method of claim 8, wherein the flowable laundry--.

Signed and Sealed this
Thirteenth Day of January, 2015

Michelle K. Lee

Michelle K. Lee
*Deputy Director of the United States Patent and Trademark Office*